US007005407B2

(12) United States Patent
Dessauer et al.

(10) Patent No.: US 7,005,407 B2
(45) Date of Patent: Feb. 28, 2006

(54) THERMAL IMAGING ELEMENTS HAVING IMPROVED STABILITY

(75) Inventors: Rolf Dessauer, Greenville, DE (US); Jeffrey Jude Patricia, Apalachin, NY (US); Gregory Charles Weed, Towanda, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 286 days.

(21) Appl. No.: 10/432,345

(22) PCT Filed: Nov. 16, 2001

(86) PCT No.: PCT/US01/43792

§ 371 (c)(1),
(2), (4) Date: May 16, 2003

(87) PCT Pub. No.: WO02/42089

PCT Pub. Date: May 30, 2002

(65) Prior Publication Data

US 2004/0027445 A1 Feb. 12, 2004

Related U.S. Application Data

(60) Provisional application No. 60/252,267, filed on Nov. 21, 2000.

(51) Int. Cl.
*B41M 5/035* (2006.01)
*B41M 5/38* (2006.01)

(52) U.S. Cl. ..... 503/227; 428/32.81; 430/945; 503/209

(58) Field of Classification Search ..... 503/201, 503/208, 209, 200, 226; 430/200, 201, 945; 428/32.81

See application file for complete search history.

(56) References Cited

U.S. PATENT DOCUMENTS

| | | | | |
|---|---|---|---|---|
| 4,788,128 | A | | 11/1988 | Barlow |
| 4,942,141 | A | | 7/1990 | DeBoer et al. |
| 4,948,776 | A | | 8/1990 | Evans et al. |
| 4,948,777 | A | | 8/1990 | Evans et al. |
| 4,948,778 | A | | 8/1990 | DeBoer |
| 4,950,639 | A | | 8/1990 | DeBoer et al. |
| 4,952,552 | A | | 8/1990 | Chapman et al. |
| 5,019,549 | A | | 5/1991 | Kellogg et al. |
| 5,085,698 | A | | 2/1992 | Ma et al. |
| 5,156,938 | A | | 10/1992 | Foley et al. |
| 5,171,650 | A | | 12/1992 | Ellis et al. |
| 5,219,823 | A | | 6/1993 | Chapman |
| 5,256,506 | A | | 10/1993 | Ellis et al. |
| 5,534,387 | A | | 7/1996 | Bodager et al. |
| 5,593,808 | A | | 1/1997 | Ellis |
| 5,622,795 | A | | 4/1997 | Ellis |
| 5,681,681 | A | | 10/1997 | Ellis |
| 5,716,754 | A | * | 2/1998 | Arnost et al. ..... 430/200 |
| 5,773,188 | A | | 6/1998 | Ellis |

FOREIGN PATENT DOCUMENTS

| | | |
|---|---|---|
| EP | 0563886 A1 | 10/1993 |
| EP | 0583661 A2 | 2/1994 |
| EP | 0761466 A1 | 3/1997 |

* cited by examiner

*Primary Examiner*—B. Hamilton Hess
(74) *Attorney, Agent, or Firm*—Thomas H. Magee

(57) ABSTRACT

A thermally imageable element having a thermally imageable layer, wherein the thermally imageable layer has a thermal amplification additive and a stabilizer selected from the group consisting of phenolic type compounds and amine type compounds. These stabilizers present in thermally imageable layers maintain NIR stability during manufacture, and when the thermally imageable elements containing them are used in thermal imaging processes.

15 Claims, 1 Drawing Sheet

THERMAL IMAGING ELEMENTS HAVING IMPROVED STABILITY

This application claims the benefit of Provisional Application No. 60/252,267, filed Nov. 21, 2000.

This invention relates to processes and products for effecting laser-induced thermal transfer imaging. More specifically, the invention relates to thermally imageable elements comprising thermally imageable compositions containing stabilizers and NIR dyes.

Laser-induced thermal transfer processes are well-known in applications such as color proofing and lithography. Such laser-induced processes include, for example, dye sublimation, dye transfer, melt transfer, and ablative material transfer.

Laser-induced processes use a laserable assemblage comprising (a) a thermally imageable element that contains a thermally imageable layer, the exposed areas of which are transferred, and (b) a receiver element having an image receiving layer that is in contact with the thermally imageable layer. The laserable assemblage is imagewise exposed by a laser, usually an infrared laser, resulting in transfer of exposed areas of the thermally imageable layer from the thermally imageable element to the receiver element. The (imagewise) exposure takes place only in a small, selected region of the laserable assemblage at one time, so that transfer of material from the thermally imageable element to the receiver element can be built up one pixel at a time. Computer control produces transfer with high resolution and at high speed.

NIR (near infrared) dyes are present in the thermally imageable layers to improve imaging characteristics of the thermally imageable element. A severe limitation present in the use of NIR dyes in the thermally imageable layer is that they have demonstrated instability through the manufacture and process of use steps. This narrow operating window has precluded the use of many NIR dyes which would otherwise function effectively in laser-induced thermal transfer processes.

A need exists for maintaining NIR stability, during manufacture and when the thermally imageable layers containing them are used in thermal imaging processes.

The invention provides a thermal imaging process using a thermally imageable layer which promotes stability of a thermal amplification additive.

In a first aspect of this invention, a thermally imageable element comprising a thermally imageable layer, wherein the thermally imageable layer comprises a thermal amplification additive and a stabilizer which is at least one of:

(a) a phenolic type compound having a structure:

(1)

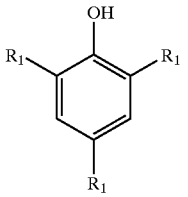

(2)

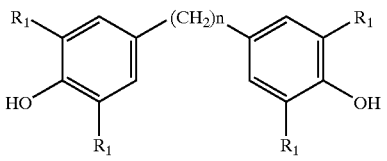

-continued (3)

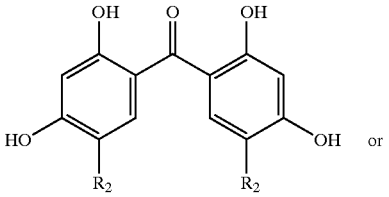

or (4)

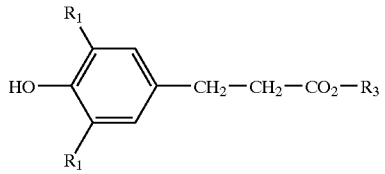

or (b) an amine type compound having a structure:

(1)

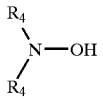

(2)

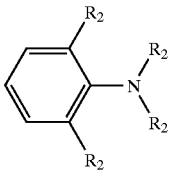

(3)

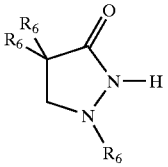

(4)

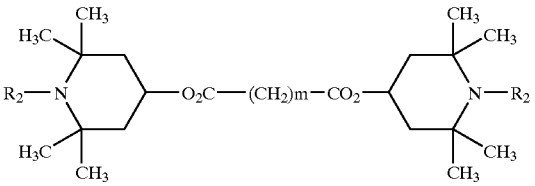

or (5)

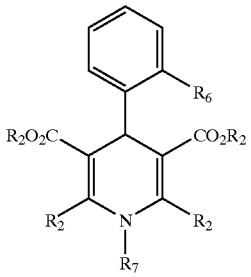

wherein: each $R_1$ independently represents a hydrogen atom, an alkyl group having 1 to about 12 carbon atoms or an alkyoxy group having 1 to about 12 carbon atoms;

n is an integer ranging from 0 to about 20;

m is an integer ranging from 1 to about 20;

each $R_2$ independently represents a hydrogen atom or alkyl group having 1 to about 12 carbon atoms or an alkoxy group having 1 to about 12 carbon atoms, $R_3$ is a hydrogen atom, alkyl group of 1 to about 20 carbon atoms or aryl group of 6 to about 20 carbon atoms;

$R_4$ is an alkyl group of 1 to about 12 carbon atoms or an aryl group of 6 to about 20 carbon atoms;

$R_5$ is a hydrogen atom, alkyl group of 1 to about 12 carbon atoms or hydroxy methyl group;

$R_6$ is an aryl group of 6 to about 20 carbon atoms;

$R_7$ is a hydrogen atom or an aryl group of 6 to about 20 carbon atoms; and $R_8$ is a hydrogen atom or nitro group.

In the first aspect, the thermally imageable layer is present on a base element comprising a support and a heating layer. Optionally, an ejection or subbing layer may be present on the support between the support and the heating layer. In the first aspect, the thermally imageable layer further comprises a colorant such as a pigment dispersion.

In a second aspect, the invention provides a method for making a color image comprising:

(1) imagewise exposing to laser radiation a laserable assemblage comprising:

(A) a thermally imageable element comprising a thermally imageable layer, wherein the thermally imageable layer comprises a thermal amplification additive and a stabilizer which is the:

(a) phenolic type compound of structure (1), (2), (3) or (4) or the (b) amine type compound of structure (1), (2), (3), (4) or (5)

(B) a receiver element comprising:

(c) a receiver support; and (d) an image receiving layer provided on the surface of the receiver support; and whereby the exposed areas of the thermally imageable layer are transferred to the receiver element to form a colorant-containing image on the image receiving layer; and (2) separating the thermally imageable element (A) from the receiver element (B), thereby revealing the colorant-containing image on the image receiving layer of the receiver element.

The revealed colorant-containing image may then be transferred directly to a permanent substrate such as paper or to a permanent substrate through an intermediate transfer step using an image rigidification element.

In the second aspect, the surface of the image receiving layer may have an average roughness (Ra) of less than about $1\mu$ and surface irregularities having a plurality of peaks, at least about 40 of the peaks having a height of at least about 200 nm and a diameter of about 100 pixels over a surface area of about $458\mu$ by about $602\mu$;

Processes and products for laser induced thermal transfer imaging are disclosed wherein thermally imageable elements having improved imaging characteristics are provided. The thermally imageable elements disclosed herein maintain shelf life stability of the thermal amplification additive, such as an NIR dye, during manufacture of the elements and also during process of use of these elements.

Before the processes of this invention are described in further detail, several different exemplary laserable assemblages made up of the combination of a receiver element, optionally having a roughened surface and a thermally imageable element will be described. The processes of this invention are fast and are typically conducted using one of these exemplary laserable assemblages.

Thermally Imageable Element

Figure 1:
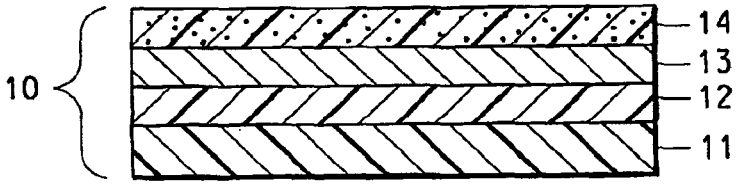
FIG. 1 illustrates a thermally imageable element (10) useful in the invention having a support (11); a base element having a coatable surface comprising an optional ejection layer or subbing layer (12) and a heating layer (13); and a thermally imageable colorant-containing layer (14).

As shown in FIG. 1, an exemplary thermally imageable element useful for thermal imaging in accordance with the processes of this invention comprises a thermally imageable colorant-containing layer (14) and a base element having a coatable surface which comprises an optional ejection layer or subbing layer (12) and a heating layer (13). Each of these layers has separate and distinct functions. Optionally, a support for the thermally imageable element (11) may also be present. In one embodiment, the heating layer (13) may be present directly on the support (11)

Support:

Typically, the support is a thick (400 gauge) coextruded polyethylene terephthalate film. Alternately, the support may be a polyester, specifically polyethylene terephthalate that has been plasma treated to accept the heating layer. When the support is plasma treated, a subbing layer or ejection layer is usually not provided on the support. Backing layers may optionally be provided on the support. These backing layers may contain fillers to provide a roughened surface on the back side of the support, i.e. the side opposite from the base element (12). Alternatively, the support itself may contain fillers, such as silica, to provide a roughened surface on the back surface of the support.

Ejection or Subbing Layer:

The ejection layer, which is usually flexible, or subbing layer (12), as shown in FIG. 1, is the layer that provides the force to effect transfer of the thermally imageable colorant-containing layer to the receiver element in the exposed areas. When heated, this layer decomposes into gaseous molecules providing the necessary pressure to propel or eject the exposed areas of the thermally imageable colorant-containing layer onto the receiver element. This is accomplished by using a polymer having a relatively low decomposition temperature (less than about 350° C., typically less than about 325° C., and more typically less than about 280° C.). In the case of polymers having more than one decomposition temperature, the first decomposition temperature should be lower than 350° C. Furthermore, in order for the ejection layer to have suitably high flexibility and conformability, it should have a tensile modulus that is less than or equal to about 2.5 Gigapascals (GPa), specifically less than about 1.5 GPa, and more specifically less than about 1 Gigapascal (GPa). The polymer chosen should also be one that is dimensionally stable. If the laserable assemblage is imaged through the ejection layer, the ejection layer should be capable of transmitting the laser radiation, and not be adversely affected by this radiation.

Examples of suitable polymers for the ejection layer include (a) polycarbonates having low decomposition temperatures (Td), such as polypropylene carbonate; (b) substituted styrene polymers having low decomposition temperatures, such as poly(alpha-methylstyrene); (c) polyacrylate and polymethacrylate esters, such as polymethylmethacrylate and polybutylmethacrylate; (d) cellulosic materials having low decomposition temperatures (Td), such as cellulose acetate butyrate and nitrocellulose; and (e) other polymers such as polyvinyl chloride; poly(chlorovinyl chloride) polyacetals; polyvinylidene chloride; polyurethanes with low Td; polyesters; polyorthoesters; acrylonitrile and substituted acrylonitrile polymers; maleic acid resins; and copolymers of the above. Mixtures of polymers can also be used. Additional examples of polymers having low decomposition temperatures can be found in U.S. Pat. No. 5,156,938. These include polymers which undergo acid-catalyzed decomposition. For these polymers, it is frequently desirable to include one or more hydrogen donors with the polymer.

Specific examples of polymers for the ejection layer are polyacrylate and polymethacrylate esters, low Td polycarbonates, nitrocellulose, poly(vinyl chloride) (PVC), and chlorinated poly(vinyl chloride) (CPVC). Most specifically are poly(vinyl chloride) and chlorinated poly(vinyl chloride).

Other materials can be present as additives in the ejection layer as long as they do not interfere with the essential function of the layer. Examples of such additives include coating aids, flow additives, slip agents, antihalation agents, plasticizers, antistatic agents, surfactants, and others which are known to be used in the formulation of coatings.

Alternately, a subbing layer (12) maybe provided in place of the ejection layer resulting in a thermally imageable element having in order at least one subbing layer (12), at least one heating layer (13), and at least one thermally imageable pigment containing layer (14). Some suitable subbing layers include polyurethanes, polyvinyl chloride, cellulosic materials, acrylate or methacrylate homopolyrners and copolymers, and mixtures thereof. Other custom made decomposable polymers may also be useful in the subbing layer. Specifically useful as subbing layers for polyester, specifically polyethylene terephthalate, are acrylic subbing layers. The subbing layer may have a thickness of about 100 to about 1000 A.

Heating Layer

The heating layer (13), as shown in FIG. 1, is deposited on the flexible ejection or subbing layer. The function of the heating layer is to absorb the laser radiation and convert the radiation into heat. Materials suitable for the layer can be inorganic or organic and can inherently absorb the laser radiation or include additional laser-radiation absorbing compounds.

Examples of suitable inorganic materials are transition metal elements and metallic elements of Groups IIIA, IVA, VA, VIA, VIIIA, IIB, IIIB, and VB of the Period Table of the Elements (Sargent-Welch Scientific Company (1979)), their alloys with each other, and their alloys with the elements of Groups IA and IIA. Tungsten (W) is an example of a Group VIA metal that is suitable and which can be utilized. Carbon (a Group IVB nonmetallic element) can also be used. Specific metals include Al, Cr, Sb, Ti, Bi, Zr, , Ni, In, Zn, and their alloys and oxides. $TiO_2$ may be employed as the heating layer material.

The thickness of the heating layer is generally about 20 Angstroms to about 0.1 micrometer, more specifically about 40 to about 100 Angstroms.

Although it is typical to have a single heating layer, it is also possible to have more than one heating layer, and the different layers can have the same or different compositions, as long as they all function as described above. The total thickness of all the heating layers should be in the range given above.

The heating layer(s) can be applied using any of the well-known techniques for providing thin metal layers, such as sputtering, chemical vapor deposition, and electron beam.

Thermally Imageable Colorant-Containing Layer:

The thermally imageable colorant-containing layer (14) is formed by applying a thermally imageable composition, typically containing a colorant, to a base element. The colorant-containing layer comprises (i) a polymeric binder which is different from the polymer in the ejection layer, and (ii) a colorant comprising a dye or a pigment dispersion.

The binder for the colorant-containing layer is a polymeric material having a decomposition temperature that is greater than about 300° C. and specifically greater than about 350° C. The binder should be film forming and coatable from solution or from a dispersion. Binders having melting points less than about 250° C. or plasticized to such an extent that the glass transition temperature is less than about 70° C. are typical. However, heat-fusible binders, such as waxes should be avoided as the sole binder since such binders may not be as durable, although they are useful as cobinders in decreasing the melting point of the top layer.

It is typical that the polymer of the binder does not self-oxidize, decompose or degrade at the temperature achieved during the laser exposure so that the exposed areas of the thermally imageable layer comprising colorant and binder, are transferred intact for improved durability. Examples of suitable binders include copolymers of styrene and (meth)acrylate esters, such as styrene/methylmethacrylate; copolymers of styrene and olefin monomers, such as styrene/ethylene/butylene; copolymers of styrene and acrylonitrile; fluoropolymers; copolymers of (meth) acrylate esters with ethylene and carbon monoxide; polycarbonates having higher decomposition temperatures; (meth)acrylate homopolymers and copolymers; polysulfones; polyurethanes; polyesters. The monomers for the above polymers can be substituted or unsubstituted. Mixtures of polymers can also be used.

Specific polymers for the binder of the colorant-containing layer include, but are not limited to, acrylate homopolymers and copolymers, methacrylate homopolymers and copolymers, (meth)acrylate block copolymers, and (meth)acrylate copolymers containing other comonomer types, such as styrene.

The polymer of the binder generally has a concentration of about 15 to about 50% by weight, based on the total weight of the colorant-containing layer, specifically about 30 to about 40% by weight.

The colorant of the thermally imageable layer may be an image forming pigment which is organic or inorganic. Examples of suitable inorganic pigments include carbon black and graphite. Examples of suitable organic pigments include color pigments such as Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751D (C.I. No. Pigment Green 7). Combinations of pigments and/or dyes can also be used. For color filter array applications, high transparency pigments ( that is at least about 80% of light transmits through the pigment) are typical, having small particle size (that is about 100 nanometers).

In accordance with principles well known to those skilled in the art, the concentration of pigment will be chosen to achieve the optical density desired in the final image. The amount of pigment will depend on the thickness of the active coating and the absorption of the colorant. Optical densities greater than 1.3 at the wavelength of maximum absorption are typically required. Even higher densities are typical.

Optical densities in the 2–3 range or higher are achievable with application of this invention.

A dispersant is usually used in combination with the pigment in order to achieve maximum color strength, transparency and gloss. The dispersant is generally an organic polymeric compound and is used to separate the fine pigment particles and avoid flocculation and agglomeration of the particles. A wide range of dispersants is commercially available. A dispersant will be selected according to the characteristics of the pigment surface and other components in the composition as known by those skilled in the art. However, one class of dispersant suitable for practicing the invention is that of the AB dispersants. The A segment of the dispersant adsorbs onto the surface of the pigment. The B segment extends into the solvent into which the pigment is dispersed. The B segment provides a barrier between pigment particles to counteract the attractive forces of the particles, and thus to prevent agglomeration. The B segment should have good compatibility with the solvent used. The AB dispersants of utility are generally described in U.S. Pat. No. 5,085,698. Conventional pigment dispersing techniques, such as ball milling, sand milling, etc., can be employed.

The pigment is present in an amount of from about 25 to about 95% by weight, typically about 35 to about 65% by weight, based on the total weight of the composition of the colorant-containing layer.

Although the above discussion was directed to color proofing, the element and process of the invention apply equally to the transfer of other types of materials in different applications. In general, the scope of the invention is intended to include any application in which solid material is to be applied to a receptor in a pattern.

The colorant-containing layer may be coated on the base element from a solution in a suitable solvent, however; it is typical to coat the layer(s) from a dispersion. Any suitable solvent can be used as a coating solvent, as long as it does not deleteriously affect the properties of the assemblage, using conventional coating techniques or printing techniques, for example, gravure printing. A typical solvent is water. The colorant-containing layer may be applied by a coating process accomplished using the WaterProof® Color Versatility Coater sold by DuPont, Wilmington, Del. Coating of the colorant-containing layer can thus be achieved shortly before the exposure step. This also allows for the mixing of various basic colors together to fabricate a wide variety of colors to match the Pantone® color guide currently used as one of the standards in the proofing industry.

Thermal Amplification Additive

A thermal amplification additive is typically present in the thermally imageable colorant-containing layer, but may also be present in the ejection layer(s) or subbing layer.

The function of the thermal amplification additive is to amplify the effect of the heat generated in the heating layer and thus to further increase sensitivity to the laser. This additive should be stable at room temperature. The additive can be (1) a decomposing compound which decomposes when heated, to form gaseous by-products(s), (2) an absorbing dye which absorbs the incident laser radiation, or (3) a compound which undergoes a thermally induced unimolecular rearrangement which is exothermic. Combinations of these types of additives may also be used.

Decomposing compounds of group (1) include those which decompose to form nitrogen, such as diazo alkyls, diazonium salts, and azido (—N3) compounds; ammonium salts; oxides which decompose to form oxygen; carbonates or peroxides. Specific examples of such compounds are diazo compounds such as 4-diazo-N,N' diethyl-aniline fluoroborate (DAFB). Mixtures of any of the foregoing compounds can also be used.

An absorbing dye of group (2) is typically one that absorbs in the infrared region. Examples of suitable near infrared absorbing NIR dyes which can be used alone or in combination include poly(substituted) phthalocyanine compounds and metal-containing phthalocyanine compounds; cyanine dyes; squarylium dyes; chalcogenopyryioacrylidene dyes; croconium dyes; metal thiolate dyes; bis (chalcogenopyrylo) polymethine dyes; oxyindolizine dyes; bis(aminoaryl) polymethine dyes; merocyanine dyes; and quinoid dyes. When the absorbing dye is incorporated in the ejection or subbing layer, its function is to absorb the incident radiation and convert this into heat, leading to more efficient heating. It is typical that the dye absorb in the infrared region. For imaging applications, it is also typical that the dye have very low absorption in the visible region.

Absorbing dyes also of group (2) include the inifrared absorbing materials disclosed in U.S. Pat. Nos. 4,778,128; 4,942,141; 4,948,778; 4,950,639; 5,019,549; 4,948,776; 4,948,777 and 4,952,552.

When present in the colorant-containing layer, the thermal amplification weight percentage is generally at a level of about 0.95-about 11.5%. The percentage can range up to about 25% of the total weight percentage in the colorant-containing layer. These percentages are non-limiting and one of ordinary skill in the art can vary them depending upon the particular composition of the layer.

The colorant-containing layer generally has a thickness in the range of about 0.1 to about 5 micrometers, typically in the range of about 0.1 to about 1.5 micrometers. Thicknesses greater than about 5 micrometers are generally not useful as they require excessive energy in order to be effectively transferred to the receiver.

Although it is typical to have a single colorant-containing layer, it is also possible to have more than one colorant-containing layer, and the different layers can have the same or different compositions, as long as they all function as described above. The total thickness of the combined colorant-containing layers are usually in the range given above.

Stabilizer

A useful stabilizer is the substituted phenolic compound defined by the structures (1), (2), (3) or (4) of group (a). Typically, stabilizers under structure (a)(1) as defined above include 2,6-di-t-butyl-4-methyl-phenol and butylated hydroxyanisole (BHA). Typically, stabilizers having structure (a)(2) as defined above include 4,4'-methylene-bis-2,6-di-t-butyl-4-methyl-phenol and 4,4'-ethylene-bis-2,6-di-t-butyl4-methyl-phenol. Typically, stabilizers having structure (a)(3) as defined above include 5,5'-di-t-butyl-2,2',4,4'-tetrahydroxybenzophenone and 2,2',4,4'-tetrahydroxybenzophenone. Typically, stabilizers having structure (a)(4) as defined above include n-octadecyl 3-(3,5-ditert-butyl-4-hydroxyphenyl)propionate Another type of stabilizer includes an amine type compound defined by the structures (1), (2), (3), (4) or (5) of group (b). Typically, stabilizers having structure (b)(1) as defined above include diethylhydroxylamine (DEHA) and dibenzylhydroxylamine (DBHA). Typically, stabilizers having structure (b)(2) as defined above include 2,6-diisopropyl-N,N-dimethyl aniline. Typically, stabilizers having structure (b)(3) as defined above include phenidone A (1-pheny-3-pyrazolidinone) manufactured by Aldrich, phenidone B (4-methyl-1-phenyl-3pyrazolidinone) manufactured by Mallinckrodt, Dimezone® (4,4-dimethyl-1-phenyl-3-pyrazolidinone) manufactured by Mallinckrodt, and Dimezone® S (4hydroxymethyl-4-methyl-1-phenyl-3-pyrazolidinone) manufactured by Mallinckrodt. Typically, stabilizers having structure (b)(4) as defined above include decanedioic acid, such as bis(2,2,6,6-tetramethyl-4-piperidinyl)ester commercially available under the name TINUVIN® 770; bis(1,2,2,6,6-pentamethyl-4-piperidinyl) ester commercially available under the name TINUVIN® 292, and bis(2,2,6,6-tetramethyl-1-(octyloxy)4-piperidinyl) ester commercially available under the name TINUVIN® 123 which are manufactured by Ciba Specialty Chemicals. Typically, stabilizers under structure (b)(5) include 3,5-Pyridinedicarboxylic acid, 1,4-dihydro-2,6-dimethyl4-(2-nitrophenyl)-, dimethyl ester sold under the name UVENP349PINA® and 3,5-Pyridinedicarboxylic acid, 1,4-dihydro-2,6-dimethyl-1,4-diphenyl-, dimethyl ester sold under the name UV-DPP337PINA® by Honeywell Specialty Chemicals.

The stabilizer may serve to protect the thermal amplification additive, more typically the NIR dye, by eliminating species in the thermally imageable element that would prematurely bleach the NIR dye and/or by reducing the effects of ambient air as the thermally imageable element ages.

The stabilizer is typically present in the amount of about 0.2 to about 2.0% by weight, more typically in the amount of about 0.3 to about 1.0% by weight, based on the total weight of the components of the thermally imageable layer. A is mixture of more than one of the phenolic stabilizers or a mixture of more than one of the amine stabilizers or a mixture of phenolic and amine stabilizers may be used.

Additional Additives

Other materials can be present as additives in the colorant-containing layer as long as they do not interfere with the essential function of the layer. Examples of such additives include coating aids, plasticizers, flow additives, slip agents, antihalation agents, antistatic agents, surfactants, and others which are known to be used in the formulation of coatings. However, it is typical to minimize the amount of additional materials in this layer, as they may deleteriously affect the final product after transfer. Additives may add unwanted color for color proofing applications, or they may decrease durability and print life in lithographic printing applications.

Additional layers:

The thermally imageable element may have additional layers. For example, an antihalation layer may be used on the side of the flexible ejection layer opposite the colorant-contaning layer. Materials which can be used as antihalation agents are well known in the art. Other anchoring or subbing layers can be present on either side of the flexible ejection layer and are also well known in the art.

In some embodiments of this invention, a material functioning as a heat absorber and a colorant is present in a single layer, termed the top layer. Thus the top layer has a dual function of being both a heating layer and a colorant-containing layer. The characteristics of the top layer are the same as those given for the colorant-containing layer. A typical material finctioning as a heat absorber and colorant is carbon black.

Yet additional thermally imageable elements may comprise alternate colorant-containing layer or layers on a support. Additional layers may be present depending of the specific process used for imagewise exposure and transfer of the formed images. Some suitable thermally imageable elements are disclosed in U.S. Pat. No. 5,773,188, U.S. Pat. No. 5,622,795, U.S. Pat. No. 5,593,808, U.S. Pat. No. 5,156,938, U.S. Pat. No. 5,256,506, U.S. Pat. No. 5,171,650 and U.S. Pat. No. 5,681,681.

Receiver Element

Figure 2:
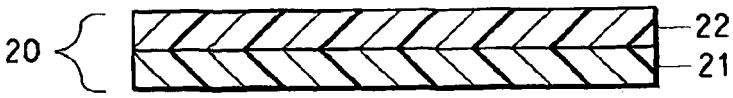
FIG. 2 illustrates a receiver element (20), optionally having a roughened surface, useful in the invention having a receiver support (21) and a image receiving layer (22).

The receiver element (20), shown in FIG. 2, is the part of the laserable assemblage, to which the exposed areas of the thermally imageable layer, typically comprising a polymeric binder and a pigment, are transferred. In most cases, the exposed areas of the thermally imageable layer will not be removed from the thermally imageable element in the absence of a receiver element. That is, exposure of the thermally imageable element alone to laser radiation does not cause material to be removed, or transferred. The exposed areas of the thermally imageable layer, are removed from the thermally imageable element only when it is exposed to laser radiation and the thermally imageable element is in contact with or adjacent to the receiver element. In one embodiment, the thermally imageable element actually touches the surface of the image receiving layer of the receiver element.

The receiver element (20) may be non-photosensitive or photosensitive. The non-photosensitive receiver element usually comprises a receiver support (21) and a image receiving layer (22). The receiver support (21) comprises a dimensionally stable sheet material. The assemblage can be imaged through the receiver support if that support is transparent. Examples of transparent films for receiver supports include, for example polyethylene terephthalate, polyether sulfone, a polyimide, a poly(vinyl alcohol-co-acetal), polyethylene, or a cellulose ester, such as cellulose acetate. Examples of opaque support materials include, for example, polyethylene terephthalate filled with a white pigment such as titanium dioxide, ivory paper, or synthetic paper, such as Tyvek® spunbonded polyolefin. Paper supports are typical for proofing applications, while a polyester support, such as poly(ethylene terephthalate) is typical for a medical hard-copy and color filter array applications. Roughened supports may also be used in the receiver element.

The image receiving layer (22) may comprise one or more layers wherein optionally the outermost layer is comprised of a material capable of being micro-roughened. Some examples of materials that are useful include a polycarbonate; a polyurethane; a polyester; polyvinyl chloride; styrene/acrylonitrile copolymer; poly(caprolactone); poly (vinylacetate), vinylacetate copolymers with ethylene and/or vinyl chloride; (meth)acrylate homopolymers (such as butyl-methacrylate) and copolymers; and mixtures thereof Typically the outermost image receiving layer is a crystalline polymer or poly(vinylacetate) layer. The crystalline image receiving layer polymers, for example, polycaprolactone polymers, typically have melting points in the range of about 50 to about 64° C., more typically about 56 to about 64° C., and most typically about 58 to about 62° C. Blends made from 5–40% Capa® 650 (melt range 58–60° C.) and Tone® P-300 (melt range 58–62° C.), both polycaprolactones, are particularly useful as the outermost layer in this invention. Typically, 100% of CAPA 650 or Tone P-300 is used. However, thermoplastic polymers, such as polyvinyl acetate, have higher melting points (softening point ranges of about 100 to about 180° C.). Useful receiver elements are also disclosed in U.S. Pat. No. 5,534,387 wherein an outermost layer optionally capable of being micro-roughened, for example, a polycaprolactone or poly (vinylacetate) layer is present on the ethylene/vinyl acetate copopolymer layer disclosed therein. The ethylene/vinyl acetate copolymer layer thickness can range from about 0.5 to about 5 mils and the polycaprolactone layer thickness from about 2 to about 100 mg/dm$^2$. Typically, the ethylene/vinyl acetate copolymer comprising more ethylene than vinyl acetate.

One preferred example is the WaterProof® Transfer Sheet sold by DuPont under Stock # G06086 having coated thereon a polycaprolactone or poly(vinylacetate) layer. This image receiving layer can be present in any amount effective for the intended purpose. In general, good results have been obtained at coating weights in the range of about 5 to about 150 mg/dm$^2$, typically about 20 to about 60 mg/dm$^2$.

In addition to the image receiving layer or layers described above, the receiver element may optionally include one or more other layers between the receiver support and the image receiving layer. A useful additional layer between the image receiving layer and the support is a release layer. The receiver support alone or the combination of receiver support and release layer is referred to as a first temporary carrier. The release layer can provide the desired adhesion balance to the receiver support so that the image-receiving layer adheres to the receiver support during exposure and separation from the thermally imageable element, but promotes the separation of the image receiving layer from the receiver support in subsequent steps. Examples of materials suitable for use. as the release layer include polyamides, silicones, vinyl chloride polymers and copolymers, vinyl acetate polymers and copolymers and plasticized polyvinyl alcohols. The release layer can have a thickness in the range of about 1 to about 50 microns.

A cushion layer which is a deformable layer may also be present in the receiver element, typically between the release layer and the receiver support. The cushion layer may be present to increase the contact between the receiver element and the thermally imageable element when assembled. Additionally, the cushion layer aids in the optional micro-roughening process by providing a deformable base under pressure and optional heat. Furthermore, the cushion layer provides excellent lamination properties in the final image transfer to a paper or other substrate. Examples of suitable materials for use as the cushion layer include copolymers of styrene and olefin monomers; such as, styrene/ethylene/butylene/styrene, styrene/butylene/styrene block copolymers, ethylene-vinylacetate and other elastomers useful as binders in flexographic plate applications.

Methods for optionally roughening the surface of the image receiving layer include micro-roughening. Micro-roughening may be accomplished by any suitable method. One specific example, is by bringing it in contact with a roughened sheet typically under pressure and heat. The pressures used may range from about 800+/– about 400 psi. Optionally, heat may be applied up to about 80 to about 88° C. (175 to 190° F.) more typically about 54.4° C. (130° F.) for polycaprolactone polymers and about 94° C. (200° F.) for poly(vinylacetate) polymers, to obtain a uniform micro-roughened surface across the image receiving layer. Alternatively, heated or chilled roughened rolls may be used to achieve the micro-roughening.

It is typical that the means used for micro-roughening of the image receiving layer has a uniform roughness across its surface. Typically, the means used for micro-roughening has an average roughness (Ra) of about 1$\mu$ and surface irregularities having a plurality of peaks, at least about 20 of the peaks having a height of at least about 200 nm and a diameter of about 100 pixels over a surface area of about 458$\mu$ by about 602$\mu$.

The roughening means should impart to the surface of the image receiving layer an average roughness (Ra) of less than about 1$\mu$, typically less than about 0.95$\mu$, and more typically less than about 0.5$\mu$, and surface irregularities having a plurality of peaks, at least about 40 of the peaks, typically at least about 50 of the peaks, and still more typically at least about 60 of the peaks, having a height of at least about 200 nm and a diameter of about 100 pixels over a surface area of about 458$\mu$ by about 602$\mu$ These measurements are made using Wyco Profilometer (Wylco Model NT 3300) manufactured by Veeko Metrology, Tucson, Ariz.

The outermost surface of the receiver element may further comprise a gloss reading of about 5 to about 35 gloss units, typically about 20 to about 30 gloss units, at an 85° angle. A GARDCO 20/60/85 degree NOVO-GLOSS meter manufactured by The Paul Gardner Company may be used to take measurements. The glossmeter should be placed in the same orientation for all readings across the transverse direction orientation.

The topography of the surface of the image receiving layer may be important in obtaining a high quality final image with substantially no micro-dropouts.

The receiver element is typically an intermediate element in the process of the invention because the laser imaging step is normally followed by one or more transfer steps by which the exposed areas of the thermally imageable layer are transferred to the permanent substrate.

Permanent Substrate

One advantage of the process of this invention is that the permanent substrate for receiving the colorant-containing image can be chosen from almost any sheet material desired. For most proofing applications a paper substrate is used, typically the same paper on which the image will ultimately be printed. Most any paper stock can be used. Other materials which can be used as the permanent substrate include cloth, wood, glass, china, most polymeric films, synthetic papers, thin metal sheets or foils, etc. Almost any material which will adhere to the thermoplastic polymer layer (34), can be used as the permanent substrate.

Process Steps

Exposure:

The first step in the process of the invention is imagewise exposing the laserable assemblage to laser radiation. The exposure step is typically effected at a laser fluence of about 600 mJ/cm$^2$ or less, most typically about 250 to about 440 mJ/cm$^2$. The laserable assemblage comprises the thermally imageable element and the receiver element.

The assemblage is normally prepared following removal of a coversheet(s), if present, by placing the thermally imageable element in contact with the receiver element such that colorant-containing layer actually touches the image receiving layer on the receiver element. Vacuum and/or pressure can be used to hold the two elements together. As one alternative, the thermally imageable and receiver elements can be held together by fusion of layers at the periphery. As another alternative, the thermally imageable and receiver elements can be taped together and taped to the imaging apparatus, or a pin/clamping system can be used. As yet another alternative, the thermally imageable element can be laminated to the receiver element to afford a laserable assemblage. The laserable assemblage can be conveniently mounted on a drum to facilitate laser imaging.

Various types of lasers can be used to expose the laserable assemblage. The laser is typically one emitting in the infrared, near-infrared or visible region. Particularly advantageous are diode lasers emitting in the region of about 750 to about 870 nm which offer a substantial advantage in terms of their small size, low cost, stability, reliability, ruggedness and ease of modulation. Diode lasers emitting in the range of about 780 to about 850 nm are most typical. Such lasers are available from, for example, Spectra Diode Laboratories (San Jose, Calif.). The device used for applying an image to the image receiving layer is the Creo Spectrum Trendsetter, which utilizes lasers emitting near 830 nm.

The exposure may take place through the optional ejection layer or subbing layer and/or the heating layer of the thermally imageable element. The optional ejection layer or subbing layer or the receiver element having a roughened surface, must be substantially transparent to the laser radiation. The heating layer absorbs the laser radiation and assists in the transfer of the colorant-contaning material. In some cases, the ejection layer or subbing layer of the thermally imageable element will be a film that is transparent to infrared radiation and the exposure is conveniently carried out through the ejection or subbing layer. In other cases, these layers may contain laser absorbing dyes which aid in material transfer to the image receiving element.

The laserable assemblage is exposed imagewise so that the exposed areas of the thermally imageable layer are transferred to the receiver element in a pattern. The pattern itself can be, for example, in the form of dots or line work generated by a computer, in a form obtained by scanning artwork to be copied, in the form of a digitized image taken from original artwork, or a combination of any of these forms which can be electronically combined on a computer prior to laser exposure. The laser beam and the laserable assemblage are in constant motion with respect to each other, such that each minute area of the assemblage, i.e., "pixel" is individually addressed by the laser. This is generally accomplished by mounting the laserable assemblage on a rotatable drum. A flat bed recorder can also be used.

Separation:

The next step in the process of the invention is separating the thermally imageable element from the receiver element. Usually this is done by simply peeling the two elements apart. This generally requires very little peel force, and is accomplished by simply separating the thermally imageable support from the receiver element. This can be done using any conventional separation technique and can be manual or automatic without operator intervention.

Separation results in a laser generated color image, also known as the colorant-containing image, typically a halftone dot image, comprising the transferred exposed areas of the thermally imageable colorant-containing layer, being revealed on the image receiving layer of the receiver element. Typically the colorant-containing imageformed by the exposure and separation steps is a laser generated halftone dot color image formed on a crystalline polymer layer, the crystalline polymer layer being located on a first temporary carrier which may or may not have a layer present directly on it prior to application of the crystalline polymer layer.

Additional Steps:

The so revealed colorant-containing image on the image receiving layer may then be transferred directly to a permanent substrate or it may be transferred to an intermediate element such as an image rigidification element, and then to a permanent substrate. Typically, the image rigidification element comprises a support having a release surface and a thermoplastic polymer layer.

The so revealed colorant-containing image on the image receiving layer is then brought into contact with, typically laminated to, the thermoplastic polymer layer of the image rigidification element resulting in the thermoplastic polymer layer of the rigidification element and the image receiving layer of the receiver element encasing the colorant-containing image. A WaterProof® Laminator, manufactured by DuPont is preferably used to accomplish the lamination. However, other conventional means may be used to accomplish contact of the colorant-containing image carring receiver element with the thermoplastic polymer layer of the rigidification element. It is important that the adhesion of the rigidfication element support having a release surface to the thermoplastic polymer layer be less than the adhesion between any other layers in the sandwich. The novel assemblage or sandwich is highly useful, e.g., as an improved image proofing system. The support having a release surface may then removed, typically by peeling off, to reveal the thermoplastic film. The colorant-containing image on the receiver element may then be transferred to the permanent substrate by contacting the permanent substrate with, typically laminating it to, the revealed thermoplastic polymer layer of the sandwich. Again a WaterProof® Laminator, manufactured by DuPont, is typically used to accomplish the lamination. However, other conventional means may be used to accomplish this contact.

Another embodiment includes the additional step of removing, typically by peeling off, the receiver support resulting in the assemblage or sandwich comprising the permanent substrate, the thermoplastic layer, the colorant-containing image, and the image receiving layer. In a more typical embodiment, these assemblages represent a printing proof comprising a laser generated halftone dot color thermal image formed on a crystalline polymer layer, and a thermoplastic polymer layer laminated on one surface to said crystalline polymer layer and laminated on the other surface to the permanent substrate, whereby the color image is encased between the crystalline polymer layer and the thermoplastic polymer layer.

Formation of Multicolor Images:

In proofing applications, the receiver element can be an intermediate element onto which a multicolor image is built up. A thermally imageable element having a thermally imageable colorant-containing layer comprising a first pigment is exposed and separated as described above. The receiver element has a colorant-containing image formed with the first pigment, which is typically a laser generated halftone dot color thermal image. Thereafter, a second thermally imageable element having a thermally imageable colorant-containing layer different than that of the first thermally imageable element forms a laserable assemblage with the receiver element having the of the first pigment and is imagewise exposed and separated as described above. The steps of (a) forming the laserable assemblage with a thermally imageable element having a different pigment than that used before and the previously imaged receiver element, (b) exposing, and (c) separating are sequentially repeated as often as necessary in order to build the multi-colorant-containing image of a color proof on the receiver element.

The rigidification element may then be brought into contact with, typically laminated to, the multiple colorant-containing images on the image receiving element with the last colorant-containing image in contact with the thermoplastic polymer layer. The process is then completed as described above.

EXAMPLES

These non-limiting examples demonstrated the processes and products described herein wherein images of a wide variety of colors were obtained. All temperatures throughout the specification were in ° C. (degrees Centigrade) and all percentages were weight percentages unless indicated otherwise.

Example 1

This example shows the effectiveness of the stabilizers in combination with an NIR dye when a film is aged in a roll storage environment.

The following control cyan solution was made and coated to 15 mg/sq dm using a #9 wire round rod onto 60% T Chrome on 4 mil Melinex® 573 (DuPont):

| Ingredients | % Solids | % Dispersant | % Pigment | Control Cyan Donor Solution (100 g sol'n) |
|---|---|---|---|---|
| Distilled Water | 0 | 0 | 0 | 73.6 |
| Polymer 1[1] | 37.4 | 100 | 0 | 22.2 |
| Penn Color 30S330 G/S[2,6] | 40 | 16 | 24 | 3.53 |
| Crysta Lyn 551143[3] | 100 | 100 | 0 | 0.145 |
| PEG 6800[4] | 100 | 100 | 0 | 0.415 |
| Zonyl ® FSD (43% FC)[5] | 100 | 100 | 0 | 0.103 |
| Total (per 100 g of solution) | 10.38 | NA | NA | 100 |

[1]is an acrylic latex copolymer of 74% methyl methacrylate and 24% butyl methacrylate
[2]is manufactured by Penn Color, PA.
[3]is an NIR dye, CAS# 162093-14-3, $\lambda_{max}$ = 819 nm, $\epsilon$ = 229,0003 CAS Name: H-Indolium, 2-[2-[3-[(1,3-dihydro-1,3,3-trimethyl-2H-indol-2-ylidene)ethylidene]-2-(2-pyrimidinylthio)-1-cyclopenten-1-yl]ethenyl]-1,3,3-trimethyl-, salt with trifluoromethanesulfonic acid (1:1)
[4]is polyethylene glycol, MW 6800
[5]is a fluorocarbon surfactant A film size of 23.25"×31.25' was prepared for each sample tested.

Additional cyan films were made the same way using the control composition, but with a given percentage of stabilizer replacing a proportionate amount of polymer 1. The resulting films in Table 1 were compared for aging properties:

TABLE 1

| Film | Additive | % Additive |
|---|---|---|
| 1 (Control) | none | 0 |
| 2 | DEHA[1] | 0.4 |
| 3 | Phenidone[2] | 0.4 |
| 4 | Dimezone S[3] | 0.5 |
| 5 | DBHA[4] | 0.5 |

[1]Diethylhydroxylamine
[2]1-Phenyl-3-pyrazolidone
[3]4-Hydroxymethyl-4-methyl-1-phenylpyrazolidone
[4]Dibenzylhydroxylamine A VIS-NIR spectrum of each film coated fresh revealed that the starting dye quantity in each film (maximum at 848 nm) was roughly the same using the cyan pigment maximun of 613 nm as an internal standard. The optical density ratio of maximum at 848 nm to maximum at 613 nm averaged 0.61+/−0.01 (std dev). Each film was rolled lengthwise to a diameter of roughly 2 inches and suspended in the dark in a 40 F/40 RH controlled temperature/humidity oven for 4 days and then removed.

The aged films were compared through spectral analysis and by evaluating the image quality of a 50% tint when exposed under control conditions on the CREO Trendsetter. The % NIR dye remaining was calculated by determining the percentage change in NIR dye in each aged film relative to its corresponding fresh film. The 50% tint image quality rated on a numerical scale: 0=poor, 1=fair, 2=good. Table 2 shows these results.

TABLE 2

| Aged Film Comparison | | |
|---|---|---|
| Film | % NIR Dye Remaining | Image Quality |
| 1 (Control) | 6 | 0.5 |
| 2 | 59 | 1.5 |
| 3 | 48 | 2.0 |
| 4 | 53 | 2.0 |
| 5 | 63 | 2.0 |

Films 2–5 which possess stabilizer additives exhibit improved dye survival relative to the no additive control film 1. This improved dye survival is correlated to the preservation of image quality of the imaged film that is aged.

Example 2

This example shows the effectiveness of stabilizers to improve NIR dye stability when a film is aged where stale/stagnant air is present and the film is passively exposed to this air. This condition could be typical of what a film experiences in a packaged environment.

The same control cyan solution from Example 1 was made and coated to 14 mg/sq dm using a #8 wire round rod onto 60% T Chrome on 4 mil Melinex® 573 (DuPont). A film size of 23.25"×31.25' was prepared for each sample tested.

Additional cyan films were made the same way using the control composition, but with a given percentage of additive replacing a proportionate amount of polymer 1. The resulting films in Table 3 were compared for aging properties:

TABLE 3

| Film | Additive | % Additive |
|---|---|---|
| 6 (Control) | none | 0 |
| 7 | DEHA | 0.4 |
| 8 | Uvinul ® 3050[1] | 0.5 |
| 9 | Helisorb ® 20[2] | 0.67 |
| 10 | DBHA | 0.5 |
| 11 | UV-ENP 349[3] | 0.7 |

[1]2,2',4,4'-Tetrahydroxybenzophenone
[2]5,5'-Di-t-butyl-2,2',4,4'-tetrahydroxybenzophenone
[3]3,5-Pyridinedicarboxylic acid, 1,4-dihydro-2,6-dimethyl-4-(2-nitrophenyl)-, dimethyl ester A VIS-NIR spectrum of each film coated fresh revealed that the starting dye quantity in each film (maximum at 848 nm) was roughly the same using the cyan pigment maximum of 613 nm as an internal standard. The OD ratio of maximum at 848 nm to maximum at 613 nm averaged 0.61+/−0.02 (std dev). Each film was rolled lengthwise into a tube having a diameter of roughly 2 inches so that the coated side of the film faced the interior of the tube. The tube was then suspended in the dark in a 40 F/40 RH controlled temperature/humidity oven for 4 days and then removed.

The aged films were sampled only at the interior portion of the tube (roughly an area of 6"×31.25") and compared through spectral analysis. The % NIR dye remaining was calculated by determining the percentage change in NIR dye in each aged film relative to its corresponding fresh film. Table 4 shows these results.

TABLE 4

| Aged Film Comparison | |
|---|---|
| Film | % NIR Dye Remaining |
| 6 (Control) | 66 |
| 7 | 82 |
| 8 | 82 |
| 9 | 79 |
| 10 | 83 |
| 11 | 77 |

Films 7–11 which possess stabilizer additives exhibit improved dye survival relative to the no additive control film 6.

What is claimed is:

1. A thermally imageable element comprising a thermally imageable layer, wherein the thermally imageable layer is capable of laser-induced thermal transfer and comprises a thermal amplification additive and a stabilizer which is at least one of:

(a) a phenotic type compound having a structure:

(1)

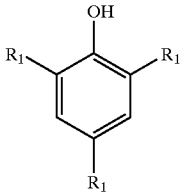

(2)

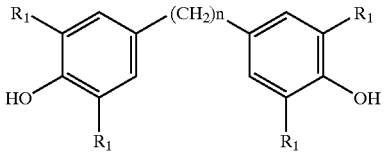

(3)

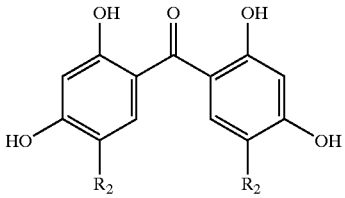

or (4)

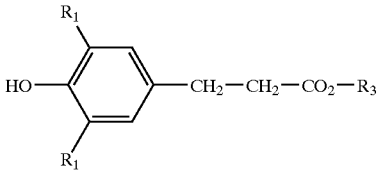

or (b) an amino type compound having a structure:

(1)

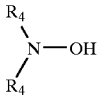

-continued (2)

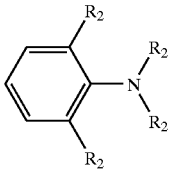

(3)

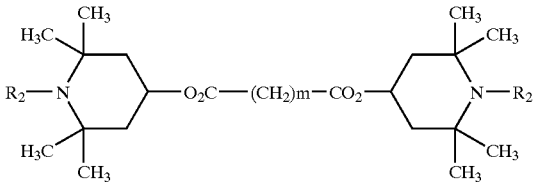

or (4)

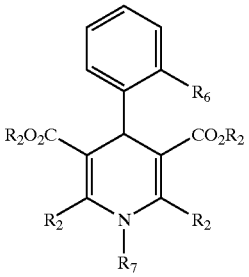

wherein: each $R_1$ independently represents a hydrogen atom, an alkyl group having 1 to about 12 carbon atoms or an alkyoxy group having 1 to about 12 carbon atoms;

n is an integer ranging from 0 to about 20;

m is an integer ranging from 1 to about 20; each $R_2$ independently represents a hydrogen atom or alkyl group having 1 to about 12 carbon atoms or an alkoxy group having 1 to about 12 carbon atoms;

$R_3$ is a hydrogen atom, alkyl group of 1 to about 20 carbon atoms or aryl group of 6to about 20 carbon atoms;

$R_4$ is an alkyl group of 1 to about 12 carbon atoms or an aryl group of 6 to about 20 carbon atoms;

$R_5$ is a hydrogen atom, alkyl group of 1 to about 12 carbon atoms or hydroxy methyl group;

$R_6$ is an aryl group of 6 to about 20 carbon atoms;

$R_7$ is a hydrogen atom or an aryl group of 6 to about 20 carbon atoms; and $R_8$ is a hydrogen atom or nitro group.

2. The thermally imageable element of claim 1 further comprising a base element comprising a support and a heating layer.

3. The thermally imageable element of claim 2 further comprising an ejection or subbing layer present on the support, between the support and the heating layer.

4. The thermally imageable element of claim 1 wherein the thermally imageable layer further comprises a colorant.

5. The thermally imageable element of claim 4 wherein the colorant is a pigment dispersion.

6. The thermally imageable element of claim 1 wherein the phenolic compound is 2,6-di-t-butyl-4-methyl phenol, 4,4'-methylene-bis-2,6-di-t-butyl-4-methyl-phenol, 2,2',4,4'-tetrahydroxybenzophenone, 5,5'-di-t-butyl-2,2',4,4'-tetrahydroxybenzophenone, or octadecyl-3-(3,5-di-t-butyl-4--hydroxyphenyl)-propionate.

7. The thermally imageable element of claim 1 wherein the amine type compound is diethylhydroxylamine, dibenzylhydroxylamine, 2,6-diisopropyl-N,N-dimethylaniline, diethylhydroxylamine, diethylhydroxylamine, 1-phany-3-pyrazolidinone, 4-methyl-1-phenyl-3-pyrazolidinone, 4,4-dimethyl-1-phenyl-3-pyrazolidinone, 4-hydroxymethyl-4-methyl-1-phenyl-3-pyrazolidinone, or 3,5-pyridinedicarboxylic acid, 1,4-dihydro-2,6-dimethyl-4-(2-nitrophenyl)-, dimethyl ester.

8. The thermally imageable element of claim 1 wherein the stabilizer is present in the amount of about 0.2 to about 2.0% by weight, based on the total weight of the thermally imageable layer.

9. The thermally imageable element of claim 1 wherein the thermal amplification additive is an absorbing dye.

10. The thermally imageable element of claim 9 wherein the absorbing dye is selected from the group consisting of poly(substituted) phthalocyanine compounds; metal-containing phthalocyanine compounds; cyanine dyes; squarylium dyes; chalcogenopyryioacrylidene dyes; croconium dyes; metal thiolate dyes; bis(chalcogenopyrylo) polymethine dyes; oxyindolizine dyes; bis(aminoaryl) polymethine dyes; merocyanine dyes; and quinoid dyes.

11. A method for making a color image comprising:

(1) imagewise exposing to laser radiation a laserable assemblage comprising:

(A) a thermally imageable element comprising a thermally imageable layer, wherein the thermally imageable layer comprises a thermal is capable of laser-induced thermal transfer and comprises a thermal amplification additive and a stabilizer which is at least one of:

(a) phenolic type compound having the structure:

(1)

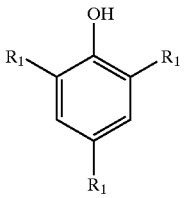

(2)

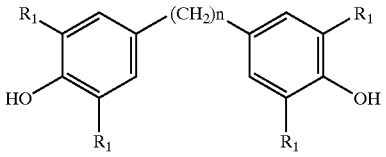

(3)

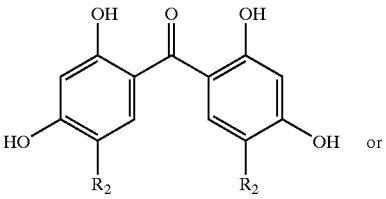

or (4)

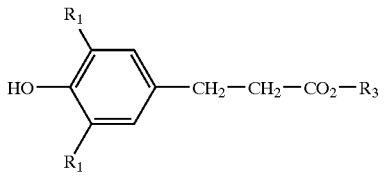

or (b) amine type compounds having the generic structures:

(1)

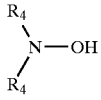

(2)

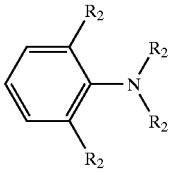

(3)

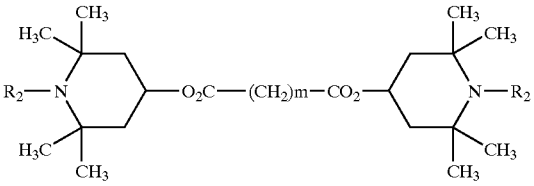

or (4)

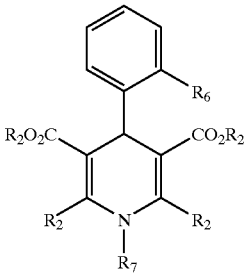

wherein; each $R_1$ independently represents a hydrogen atom, an alkyl group having 1 to about 12 carbon atoms or an alkyoxy group having 1 to about 12 carbon atoms;

n is an integer ranging from 0 to about 20;

m is an integer ranging from 1 to about 20;

each $R_2$ independently represents a hydrogen atom or alkyl group having 1 to about 12 carbon atoms or an alkoxy group having 1 to about 12 carbon atoms;

$R_3$ is a hydrogen atom, alkyl group of 1 to about 20 carbon atoms or aryl group of 6 to about 20 carbon atoms;

$R_4$ is an alkyl group of 1 to about 12 carbon atoms or an aryl group of 6 to about 20 carbon atoms;

$R_5$ is a hydrogen atom, alkyl group of 1 to about 12 carbon atoms or hydroxy methyl group;

$R_6$ is an aryl group of 6 to about 20 carbon atoms;

$R_7$ is a hydrogen atom or an aryl group of 6 to about 20 carbon atoms; and $R_8$ is a hydrogen atom or nitro group; and (B) a receiver element comprising:

(c) a receiver support; and (d) an image receiving layer provided on the surface of the receiver support; and whereby the exposed areas of the thermally imageable layer are transferred to the receiver element to form a colorant-containing image on the image receiving layer; and (2) separating the thermally imageable element (A) from the receiver element (B), thereby revealing the colorant-containing image on the image receiving layer of the receiver element.

12. The method of claim 11 wherein the thermal amplification additive is an absorbing dye.

13. The method of claim 12 wherein the absorbing dye is selected from the group consisting of poly(substituted)

phthalocyanine compounds; metal-containing phthalocyanine compounds; cyanine dyes; squarylium dyes; chalcogenopyryioacrylidene dyes; croconium dyes; metal thiolate dyes; bis(chalcogenopyrylo) polymethine dyes; oxyindolizine dyes; bis(aminoaryl) polymethine dyes; merocyanine dyes; and quinoid dyes.

14. The thermally imageable element of claim 1 in which the stabilizer comprises a combination of a phenolic type compound of formula (a) and an amine type compound of formula (b).

15. The method of claim 11 in which the stabilizer comprises a combination of a phenolic type compound of formula (a) and an amine type compound of formula (b).

* * * * *